US008403063B2

(12) United States Patent
Inglis

(10) Patent No.: US 8,403,063 B2
(45) Date of Patent: Mar. 26, 2013

(54) DOWNHOLE BALL MECHANISM WITH ENHANCED DRIFT CLEARANCE

(75) Inventor: Peter Derek Walter Inglis, Dundee Tayside (GB)

(73) Assignee: Halliburton Energy Services, Inc., Houston, TX (US)

( * ) Notice: Subject to any disclaimer, the term of this patent is extended or adjusted under 35 U.S.C. 154(b) by 622 days.

(21) Appl. No.: 12/245,287

(22) Filed: Oct. 3, 2008

(65) Prior Publication Data

US 2010/0084138 A1 Apr. 8, 2010

(51) Int. Cl.
*E21B 34/06* (2006.01)

(52) U.S. Cl. ..... 166/373; 166/316

(58) Field of Classification Search ..... 166/332.4, 166/334.2, 316, 373, 386; 251/315.01, 315.16
See application file for complete search history.

(56) References Cited

U.S. PATENT DOCUMENTS

| | | | | |
|---|---|---|---|---|
| 3,007,669 | A * | 11/1961 | Fredd | 251/31 |
| 3,398,762 | A | 8/1968 | Fredd | |
| 3,403,887 | A * | 10/1968 | Myers | 251/209 |
| 4,289,165 | A | 9/1981 | Fredd | |
| 4,550,780 | A * | 11/1985 | Mott | 166/323 |
| 4,576,234 | A | 3/1986 | Upchurch | |
| 5,305,986 | A * | 4/1994 | Hunt | 251/207 |
| 5,810,087 | A * | 9/1998 | Patel | 166/373 |
| 5,950,733 | A | 9/1999 | Patel | |
| 6,230,807 | B1 | 5/2001 | Patel | |
| RE39,658 | E * | 5/2007 | Carlson et al. | 251/209 |
| 2004/0035586 | A1 * | 2/2004 | Gudmestad et al. | 166/373 |
| 2007/0278438 | A1 | 12/2007 | Scott et al. | |
| 2009/0120207 | A1 * | 5/2009 | Ohtani et al. | 73/861.42 |

FOREIGN PATENT DOCUMENTS

| | | |
|---|---|---|
| GB | 1 372 166 A | 10/1974 |
| GB | 1 490 438 A | 11/1977 |
| GB | 2 443 109 A | 4/2008 |

OTHER PUBLICATIONS

Notification of Transmittal of the International Search Report and the Written Opinion of the International Searching Authority, or Declaration (3 pages); International Search Report (4 pages); and Written Opinion of the International Searching Authority (6 pages), mailed Mar. 30, 2010, for related international application PCT/US2009/059436.

Halliburton Communications, *Completion Tools: PES FS1 Fluid Loss Control Device*, Apr. 2005, 2 pages.

(Continued)

*Primary Examiner* — Thomas A Beach
*Assistant Examiner* — James Sayre
(74) *Attorney, Agent, or Firm* — Scott Wendorf; Fish & Richardson P.C.

(57) ABSTRACT

A downhole tool including a ball valve having a pivotal ball and providing full drift clearance through a fluid pathway of the valve over a portion of a pivotal range of the ball is described. An internal bore of the ball includes a first opening larger than a second opening, and the internal bore transitions between the first and second openings. The first opening overlays or encompasses an opening formed by a first bore portion over a range of pivot of the ball, and the second opening may be fully encompassed by an opening formed by a second bore portion over a pivotal range when the internal bore is not centrally aligned with the first or second bore portions.

46 Claims, 7 Drawing Sheets

OTHER PUBLICATIONS

Schlumberger, *FIV Technology: Protecting Formations*, Feb. 2003, 8 pages.

Halliburton, Power Point Presentation: *Diamond Series: Interventionless Completion Solutions and Techniques*, date unknown but at least as early as Oct. 31, 2007, 20 pages.

Notification Concerning Transmittal of International Preliminary Report on Patentability (2 pages); and Written Opinion of the International Searching Authority (5 pages), mailed Apr. 14, 2011, for related international application PCT/US2009/059436.

* cited by examiner

DOWNHOLE BALL MECHANISM WITH ENHANCED DRIFT CLEARANCE

TECHNICAL FIELD

This invention relates to a ball valve having an enhanced drift clearance and, particularly, to a downhole ball valve that maintains a full drift clearance over a pivotal range of ball.

BACKGROUND

Ball valves may be used in downhole applications, for example, as part of a downhole system, such as a tubular working string, for altering a fluid flow through the downhole system by pivoting a ball of a ball valve over a range of pivot. In some instances, downhole systems may be used to perform subsurface flow control operations, completion operations, or well intervention operations. Thus, some downhole systems may inject fluids into a wellbore or recover fluids from the wellbore. For example, some downhole systems may be used to inject a fluid into at least a portion of a wellbore, such as during a fracturing operation, a acidizing operation, or some other operation in which fluid may be introduced into a wellbore through a downhole system.

In some cases, the fluid introduced into or recovered from the wellbore may contain solid material. For example, a wellbore fluid to be removed by a downhole system may include wellbore cuttings and/or other debris. In still other instances, the downhole system may be used to pump a fracturing fluid containing a proppant (i.e., particles entrained in a fluid used to fracture a subterranean zone). Thus, downhole systems may be used to conduct fluids containing debris or other solid material into or out of a wellbore.

SUMMARY

A downhole tool for performing an operation downhole according to one aspect includes a bore having a first bore portion and a second bore portion. A ball may be disposed between the first bore portion and the second bore portion and adapted to pivot between a first position and a second position. The ball may include an internal bore extending from a first opening of the internal bore to a second opening of the internal bore. The first opening may be larger than the second opening. Also, the first opening may be larger than the second opening, and the first opening may encompass the opening defined by the first bore portion over a range of pivot of the ball.

Another aspect includes a downhole tool for performing an operation within a wellbore. The downhole tool may include a fluid pathway and a ball disposed in the fluid pathway. The ball may be pivotable in the fluid pathway and include a bore having a first opening larger than a second opening. As such, the first opening may fully encompass an opening of the fluid pathway adjacent the first opening over a range of pivot of the ball.

A further aspect includes a method of introducing controlling fluid flow through a downhole tool disposed downhole. The method may include providing downhole a downhole tool having a ball disposed within a fluid pathway of the downhole tool. The ball may include a bore extending therethrough. The method may also include pivoting the ball within the fluid pathway to permit full communication down the fluid pathway. Further, full communication may be permitted over a range of pivot of the ball.

The various aspects may include one or more of the following features. The first opening of the internal bore may be elliptical and include a minor axis at least as large as a width of the opening defined by the first bore portion and a major axis greater than a height of the opening defined by the first bore portion. The first opening may encompass the opening defined by the first bore portion over a range of pivot of the ball. The range of pivot of the ball may be four degrees. A pivotal range of the ball between the first position and the second position may be 92 degrees. The internal bore may transition between the first opening and the second opening. At least a portion of the internal bore may transition parabolically, conically, or in a step-wise manner. The internal bore may transition over a length of the internal bore. An opening defined by the second bore portion adjacent the ball may be flared, and the flared opening may encompass the second opening over a range of pivot of the ball. The internal bore may include one of a smooth bore or a faceted bore. An opening defined by the second bore portion may be sized to encompass the second opening of the internal bore over a range of pivot of the ball.

The various aspects may also include one or more of the following features. The range of pivot of the ball may be four degrees. The ball may be pivotable over a full range of pivot, and the full range of pivot may be 92 degrees. The first opening of the bore may be elliptical. A minor axis of elliptical first opening may be at least as large as a width of the opening of the fluid pathway, and the major axis of the first opening may be greater than a height of the opening of the first bore portion so that the first opening fully encompasses the opening of the fluid pathway over the range of pivot of the ball. The second opening of the bore may be circular, and the bore may transition from the elliptical first opening to the circular second opening over a length of the bore. A transition of the bore from the first opening to the second opening may be at least partially parabolic, conical, or stepped. The bore may include one of a smooth bore or a faceted bore. An opening of the fluid pathway adjacent the second opening of the ball may be flared, and the flared opening of the fluid pathway may fully encompass the second opening of the ball over the range of pivot of the ball.

The various aspects may further include one or more of the following features. A fluid may be pumped through the fluid pathway, and the pumped fluid may include a proppant. The ball may be positioned in a closed position to prevent or substantially prevent communication through the fluid pathway. The bore of the ball may include a first opening larger than a second opening, and the first opening may be positioned upstream of the second opening when the ball is pivoted within the fluid pathway to permit full communication down the fluid pathway.

The details of one or more implementations are set forth in the accompanying drawings and the description below. Other features, objects, and advantages will be apparent from the description and drawings, and from the claims.

DETAILED DESCRIPTION

Figure 1:
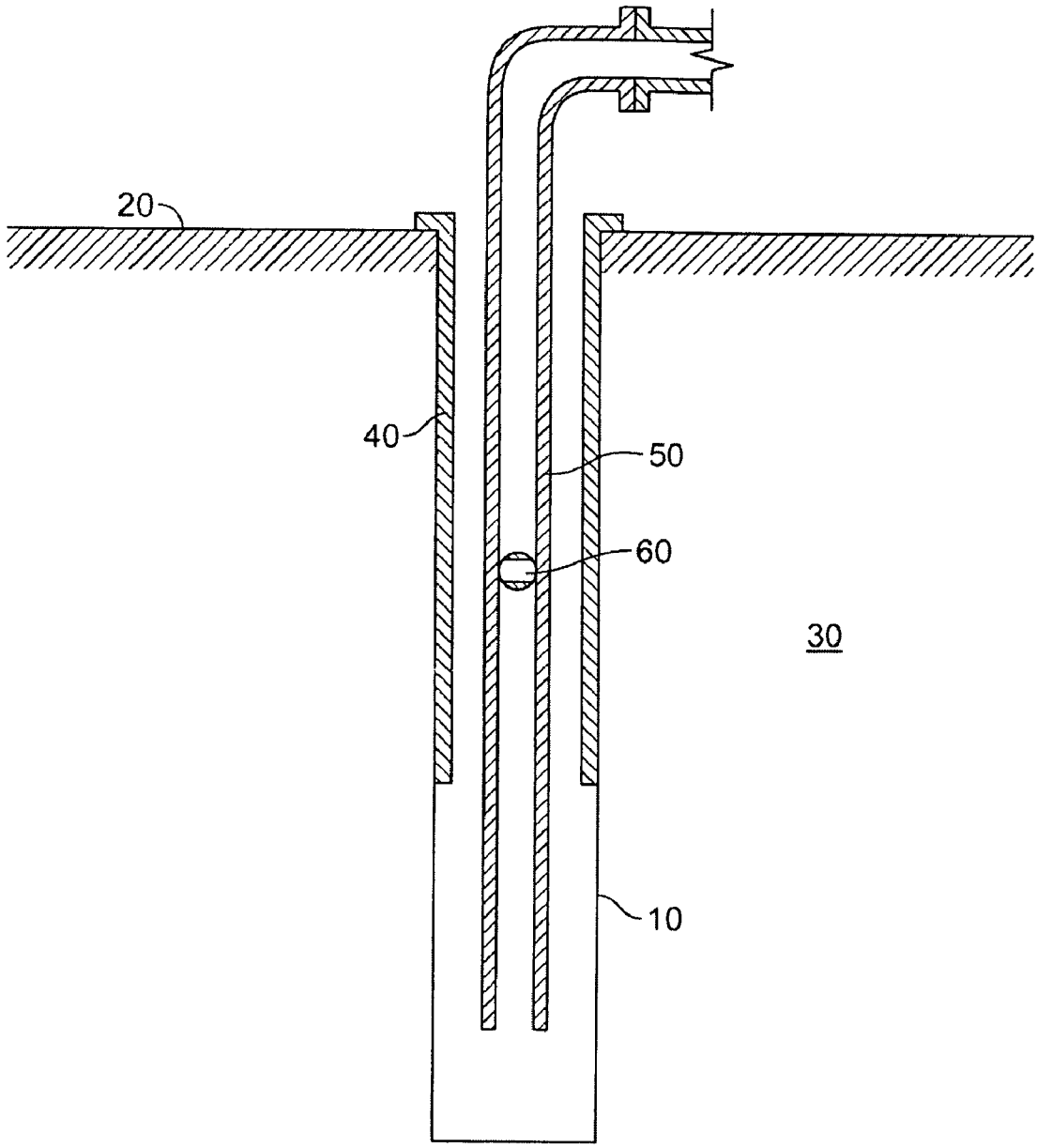
FIG. 1 shows a schematic of a wellbore extending from a terranean surface and having a downhole system disposed therein.

The present disclosure encompasses a ball valve that may be used as part of a downhole system for controlling a fluid flow through the downhole system. An example downhole system is illustrated in FIG. 1. FIG. 1 shows a wellbore 10 extending from a terranean surface 20 into a subterranean zone 30. A wellbore casing 40 extends along at least a portion of the wellbore 10. The example downhole system 50 extends into the wellbore 10 and includes a ball valve 60. In some implementations, the downhole system 50 includes a tubular working string or other tubular for at least one of introducing a fluid into the wellbore 10 or recovering a fluid from the wellbore 10. In some implementations, the ball valve 60, described herein, may be included in any number of downhole tools. Example downhole tools may include a remote opening fluid loss valve ("FS Valve"), a mechanical opening fluid loss valve ("IB Valve"), a lubricator valve ("LV Valve"), or a ball safety valve.

Ball valves as described in the present disclosure may be applicable to any number of downhole operations. For example, the ball valves may be used in fluid loss situations to prevent loss of well fluid into a subterranean zone of a reservoir. Other applications include using the ball valve as a barrier valve to prevent fluid movement through the a downhole system and provide pressure isolation. Other application are also possible including other downhole operations involving introduction of fluids into or removal of fluids out of a wellbore.

Figure 2:
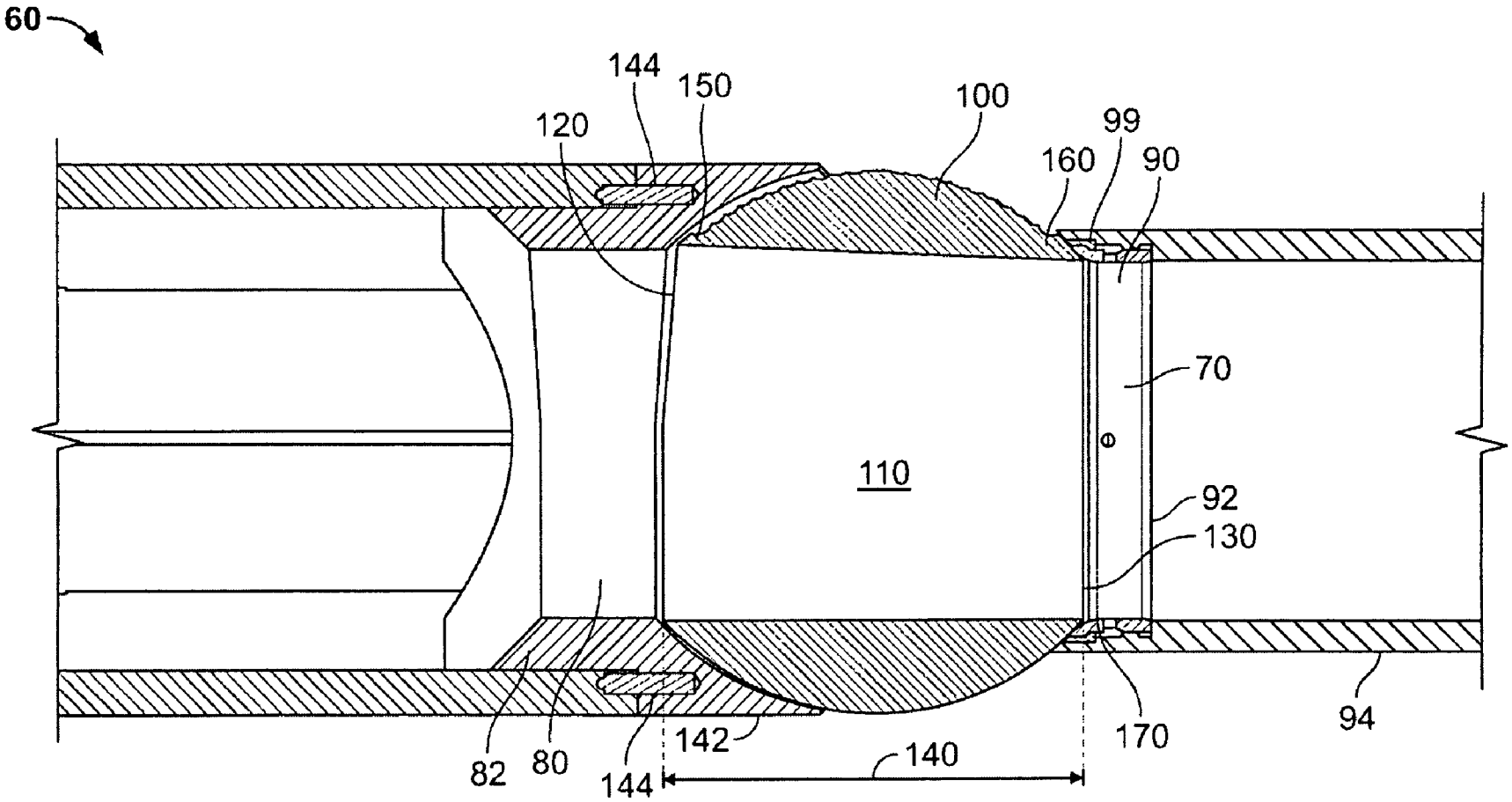
FIG. 2 is a cross-sectional view of an example ball valve.

An example ball valve 60 is shown in FIG. 2. The ball valve 60 includes a ball 100 pivotal therein and having an internal bore 110; a first housing portion 82 defining a first bore portion 80; a second housing portion 92 defining a second bore portion 90; a cylindrical member 94; a wiper member 99 disposed between the second housing portion 92 and the cylindrical member 94; and a fluid pathway 70 formed through the first bore portion 80 and the second bore portion 90. According to some implementations, the ball valve 60 may also include one or more alignment dowels 144 adapted to align the ball valve 60 with other components of a downhole system, such as downhole system 50. For instance, the alignment dowels 144 may be used to align at least one of the first bore portion 80 or second bore portion 90 with a pipe section of the downhole system 50. Consequently, the alignment dowels 144 reduce or eliminate clearance gaps between the ball valve 60 and adjacent parts of the downhole system 50 as well as improve a fluid flow profile through the ball valve 60, resulting in a reduced head or pressure loss across the ball valve 60.

The ball 100 is disposed in the fluid pathway between the first and second bore portions 80, 90. According to some implementations, either or both of the openings defined by the first or second bore portions 80, 90 may be circular, oval (e.g., elliptical), or have some other suitable shape. Further, the openings defined by the first and second bore portions 80, 90 may be the same size or different sizes. That is, in some implementations, the opening defined by the first bore portion 80 may be larger than the opening defined by the second bore portion 90. Alternatively, the opening of the second bore portion 90 may be larger than the opening defined by the first bore portion 80.

The first housing portion 82 may include a debris wiper housing 142 that cradles a portion of the ball 100. The debris wiper housing 142 is operable to remove debris from the ball 100 as the ball 100 is pivoted. The second housing portion 92 may also function to remove debris from the ball 100, particularly from the sealing surface 93 of the ball 100. Also, the second housing portion 92 may cooperate with a sealing surface of the ball 100 surrounding an opening of the internal bore 110, such as surface 93, to form a seal around the opening of the internal bore 110 of the ball 100. In some implementations, a biasing member, such as a spring, may bias the second housing portion 92 into contact with the surface 93 to form as seal.

In some implementations, a seal may be formed around only one of the openings of the internal bore 110 (e.g., first or second openings 120, 130, discussed below). In other implementations, a seal may be formed around both openings of the internal bore 110 (e.g., the first and second openings 120, 130). When a seal is desired around both the first and second openings 120, 130, the first housing portion 82 may be replaced by components similar to the second housing portion 92, the wiper member 99, and the cylindrical member 94 to cooperate with a sealing surface 95 of the ball 100 surrounding the first opening 120.

According to some implementations, the wiper member 99 may be formed from a polymeric material, and the ball 100 second housing portion 92, and the first housing portion 82, may be formed from metals, such as a steel containing 13% chromium by weight, Incoloy® 718, Inconel® 925, or 4140 alloy steel.

Figure 3:
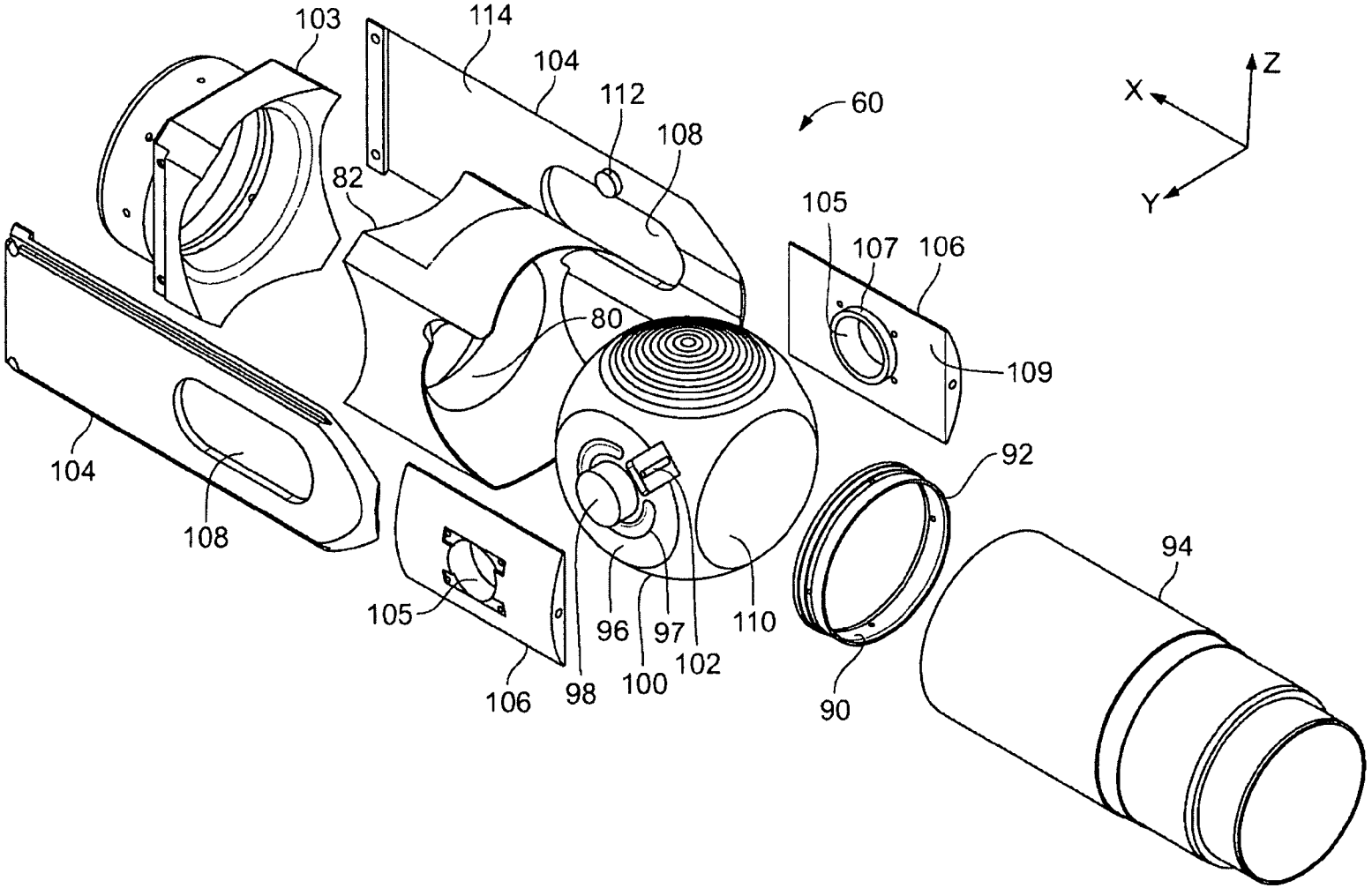
FIG. 3 is an exploded view of an example ball valve.
Figure 4:
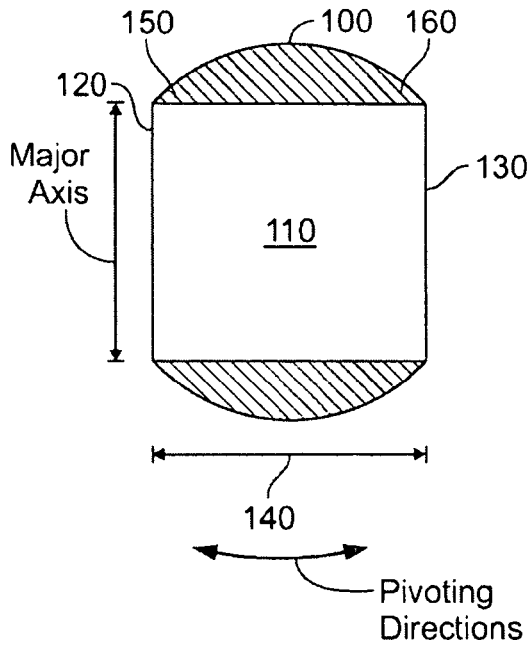
FIG. 4 is a cross-sectional view of another example ball valve.
Figure 5:
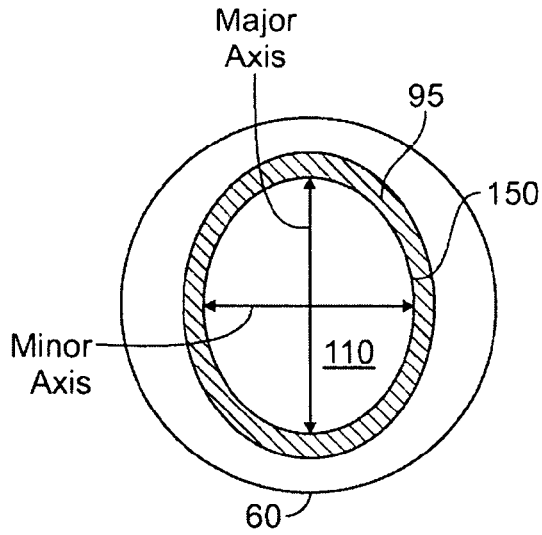
FIG. 5 is a front view of the example ball valve of FIG. 4.
Figure 6:
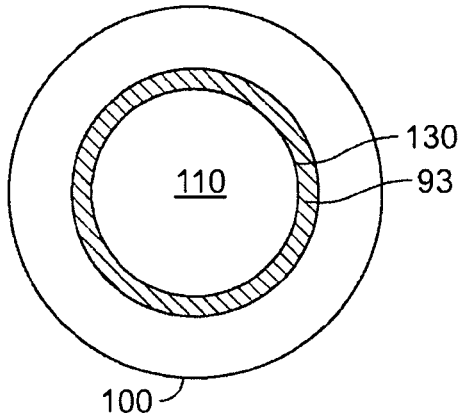
FIG. 6 is a rear view of the example ball valve of FIG. 4.

FIG. 3 illustrates an example ball valve 60, including a mechanism 103 for articulating the ball 100 between an open position and a closed position or vice versa. As shown, the ball 100 is disposed between the first housing portion 82 and the second housing portion 92. The cylindrical member 94 is coupled to the second housing portion 92. For example, the second housing portion 92 may be retained in the cylindrical member 94 by mating threads. The wiper member 99 may be retained between the second housing portion 92 and the cylindrical member 94 in a gap formed therebetween, as shown in the example ball valve 60 illustrated in FIGS. 7-9. The ball 100 may be a truncated sphere having planar surfaces 96 formed on opposite sides of the ball 100, although only one of the planar surfaces 96 is visible in FIG. 3. A cylindrical projection 98 extends from each of the planar surfaces 96. A radial groove 102 may also be formed on each of the planar surfaces 96. An arc-shaped groove 97 may also be formed on each of the planar surfaces 96.

The mechanism 103 includes a pair of arms 104 and members 106. The members 106 include apertures 105 and a raised rim 107 extending from an inner surface 109. Each arm 104 is disposed in a plane that is parallel with respective planar surfaces 96. The cylindrical projections 98 extend through slots 108 formed through each of the arms 104 and are received into the apertures 105. The raised rims 107 also extend into the slots 108. Thus, the arms 104 are sandwiched between the members 106 and the ball 100. The raised rims 107 are retained in the slots 108 such that the arms 104 are permitted to slide in a direction parallel to the X-axis but are prevented from moving in a direction parallel to the Z-axis. Actuation pins 112 are provided on an inner surface 114 of each arm 104. The actuation pins 112 are received into the radial grooves 102 formed in the ball 100. A bearing may be positioned between each pin 112 and radial groove 102. A bearing may also be positioned between each cylindrical projection 98 and the raised rims 107.

In an open position, the radial grooves 102 are angularly positioned so that the internal bore 110 of the ball 100 at least partially aligns with the first and second bore portions 80, 90 so as to provide fluid communication through the ball valve 60. In a closed position, the ball 100 may be pivoted about the Y-axis until the internal bore 110 of the ball 100 does not provide fluid communication between the first and second bore portions 80, 90, thereby preventing fluid communication through the ball valve 60. The ball 100 may be rotated between the open and closed positions, thereby opening and closing the ball valve 60, by longitudinally displacing the mechanism 103 relative to the ball 100 in a direction parallel with the X-axis. As the mechanism 103 is moved relative to the ball 100, the actuation pins 112 slide within the radial grooves 102, causing the ball 100 to pivot.

The ball valve 60 may be opened or closed in any number of ways. For example, in some implementations, the ball valve 60 may be actuated by shifting a mandrel in a longitudinal direction of the valve, e.g., a direction aligned with an axial direction of the first or second bore portions 80, 90, to rotate the ball 100 into one of an open or closed position. In some instances, the mandrel may be shifted by application of a mechanical force transferred to the mandrel through a secondary tool. In other implementations, the ball valve 60 may be opened by application of fluid pressure. For example, fluid pressure may be applied to a ball 100 in a closed position. The fluid pressure may actuate a secondary mechanism that releases a biasing element, such as a spring, to pivot the ball 100 into an open position. The examples described above, through, are not intended to be limiting. Accordingly, other manners of actuating the ball valve 100 are within the scope of this disclosure.

Other implementations of the ball valve 60 may include additional or different elements than those illustrated in the figures. Further, in some implementations, some described elements may be omitted.

Referring to FIGS. 2-6, the internal bore 110 of the ball 100 includes the first opening 120 and the second opening 130 and has a length 140. As shown, the first opening 120 is larger than the second opening 130. However, in other implementations, the first opening 120 may be smaller than the second opening 130. A lip 150 surrounds the first opening 120, and a second lip 160 surrounds the second opening 130. The internal bore 110 transitions between the first opening 120 and the second opening 130. According to some implementations, the internal bore 110 tapers between the first and second openings 120, 130. In some cases, the transition may be a conical (i.e., funneled) taper (such as the internal bore 110 in FIG. 4), a parabolic taper, or a stepped transition between the first and second openings 120, 130. In still other implementations, the transition may be over all or a portion of the length 140. Further, in some implementations, the internal bore 110 may be a smooth bore, while, in others, the internal bore may be formed from a plurality of faceted surfaces.

The ball 100 is pivotal over a range between a first position and a second position. In some implementations, the pivotal range may be 92 degrees between the first and second positions. However, in other implementations, the pivotal range may be greater or less than 92 degrees. For example, in some instances, the pivotal range may be 90 degrees plus or minus one or two degrees. Thus, the pivotal range may be any pivotal range from 88 degrees (i.e., zero to 88 degrees) of pivot to 92 degrees (i.e., zero to 92 degrees) of pivot. In other implementations, the pivotal range may be 90 degrees plus or minus one half (0.5) of a degree. Still other implementations may have greater or lesser pivotal ranges. A first portion of the pivotal range (interchangeably referred to as "closed articulation range") may correspond to a closed configuration in which fluid is prevented or substantially prevented from passing through the fluid pathway 70. A second portion of the pivotal range (interchangeably referred to as "open pivotal range") corresponds to an open configuration in which the internal bore 110 of the ball 100 provides fluid communication between the first and second bore portions 80, 90. In some implementations, fluid is prevented from passing through the fluid pathway 70 in the closed configuration because no portion of the internal bore 110 is aligned with the first and second bore portions 80, 90, and fluid is permitted to flow through the fluid pathway 70 in the open configuration because at least a portion of the internal bore 110 is open to the first and second bore portions 80, 90.

The ball 100 permits full drift clearance over a portion of the open pivotal range (referred to hereinafter as the "drift clearance pivotal range"). According to some implementations the drift clearance pivotal range is four degrees, approximately four degrees, or some other pivotal range. According to still other implementations, the drift clearance pivotal range may be greater or less than four degrees. For example, in some implementations, the drift clearance pivotal range may be two degrees, three degrees, five degrees, or six degrees. In still other implementations, the drift clearance pivotal range may be greater or lesser. For example, in other implementations the drift clearance pivotal range may be 10 degrees. In still other implementations, the second position of the ball 100 may define an end of both the pivotal range and the drift clearance pivotal range. That is, an end of the pivotal range and the drift clearance pivotal range may coincide with each other, according to some implementations. This feature is described in more detail below with reference to FIGS. 7-9. Moreover, a ball valve including the features described herein provides improved flow through the ball valve even beyond the drift clearance pivotal range due to the configuration of the internal bore 110, such as the enlarged opening of the first opening 120 relative to the opening defined by the first bore portion 80. In other words, even when the pivot of the ball 100 is outside of the drift clearance pivotal range but within the open pivotal range, flow through the ball 100 is improved due to the configuration of the internal bore 110 and the openings defined by the first and second bore portions 80, 90, described above.

Drift clearance is defined as the largest object that may be passed through a valve. For a ball valve, drift clearance is maximized when the internal bore of the ball is aligned with the first and second bore portions, i.e., a lip of the ball bordering the first or second openings of the internal bore (such as lips 150, 160) is not protruding beyond the first or second bore portions and into the fluid pathway. Any portion of the ball protruding past the first or second bore portions reduces the size of the largest object that may be passed through the ball valve, as well as increasing a pressure drop through the valve. Thus, even the slightest misalignment of the ball within the fluid pathway may reduce the size of debris or other object disposed in the fluid passing through the ball valve.

Thus, to overcome these difficulties associated with downhole operations, the ball valve 60 provides full drift clearance over a range of pivot of the ball 100. Particularly, the size of the first opening 120 of the internal bore 110 may be larger than the opening defined by the first bore portion 80. Accordingly, the first opening 120 of the internal bore 110 fully encompasses the opening defined by the first bore portion 80 over the drift clearance pivotal range. Stated another way, the opening area defined by the first bore portion 80 is entirely overlaid by the area defined by the first opening 120 of the internal bore 110 over the drift clearance pivotal range. Therefore, over the drift clearance pivotal range, when the internal bore 110 of the ball 100 is misaligned in the fluid pathway 70 due to over or under rotation of the ball 100, the lip 150 of the ball 100 does not protrude past the opening defined by the first bore portion 80 and into the fluid pathway 70. Consequently, over a pivotal range of the ball 100, the ball valve 60 maintains full drift clearance through the fluid pathway 70.

According to some implementations, the first opening 120 may be circular, while in other implementations, the first opening 120 may be oval (e.g., elliptical), although the first opening 120 may have other shapes. Also, the second opening 130 may be circular, oval (e.g., elliptical), or have other shapes. In some instances when the first opening 120 has an elliptical shape, the ellipse may be oriented such that the minor axis may be equal to or larger than the opening formed by the first bore portion 80. For example, if the opening of the first bore portion 80 is circular, the minor axis of the elliptical first opening 120 may be at least as large as the diameter of the first bore portion 80. Further, the minor axis of the elliptical first opening 120 may be oriented perpendicularly to the direction of pivot of the ball 100. The major axis of the ellipse may be aligned with the direction of pivot of the ball 100 (see FIGS. 4 and 5) and have a length so that the formed ellipse fully encompasses or overlays the opening formed by the first bore portion 80 over the entire drift clearance pivotal range, thereby maintaining full drift clearance through the fluid pathway 70.

Figure 7:
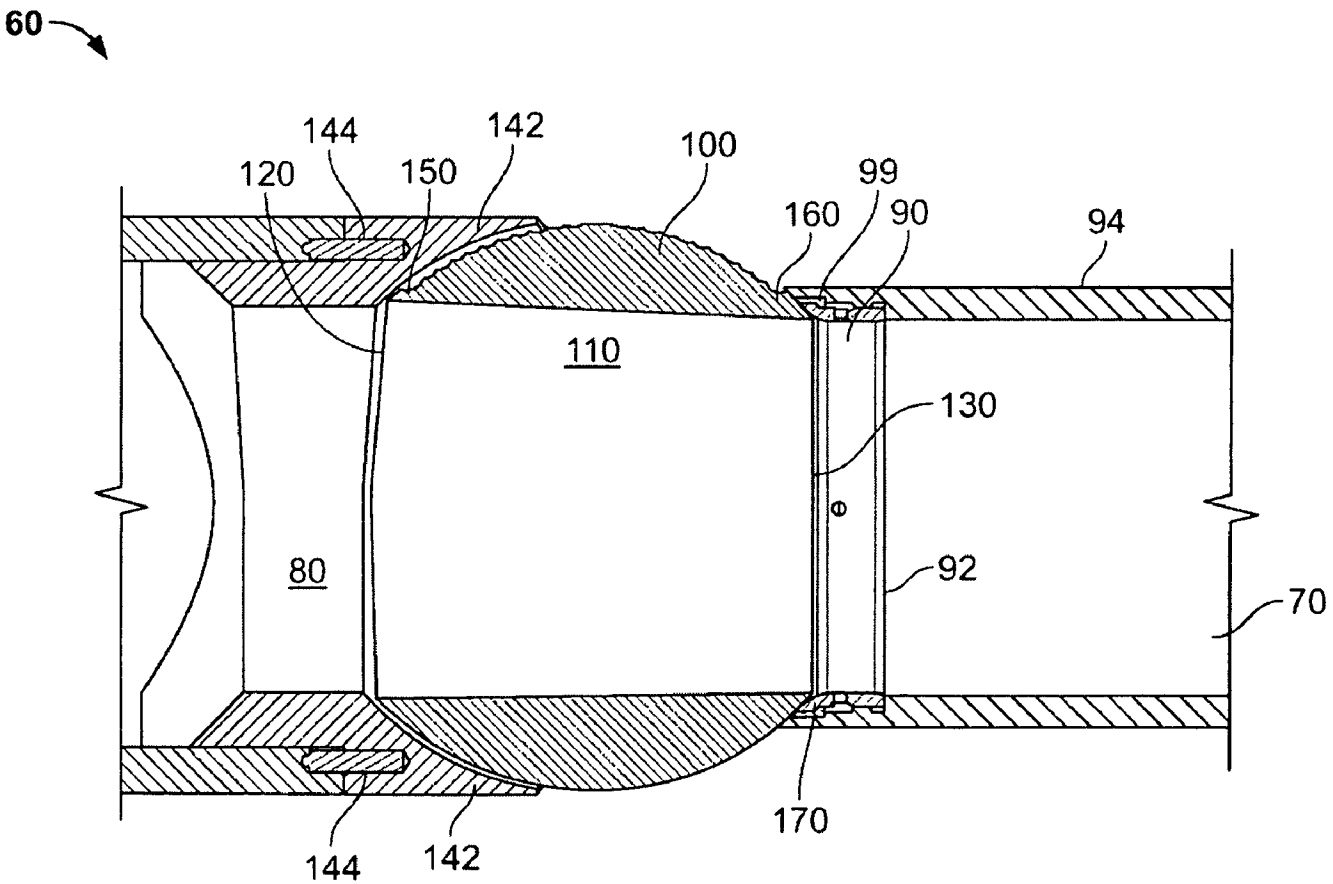
FIGS. 7-9 show the example ball valve of FIG. 2 in which the ball is at different positions.
Figure 8:
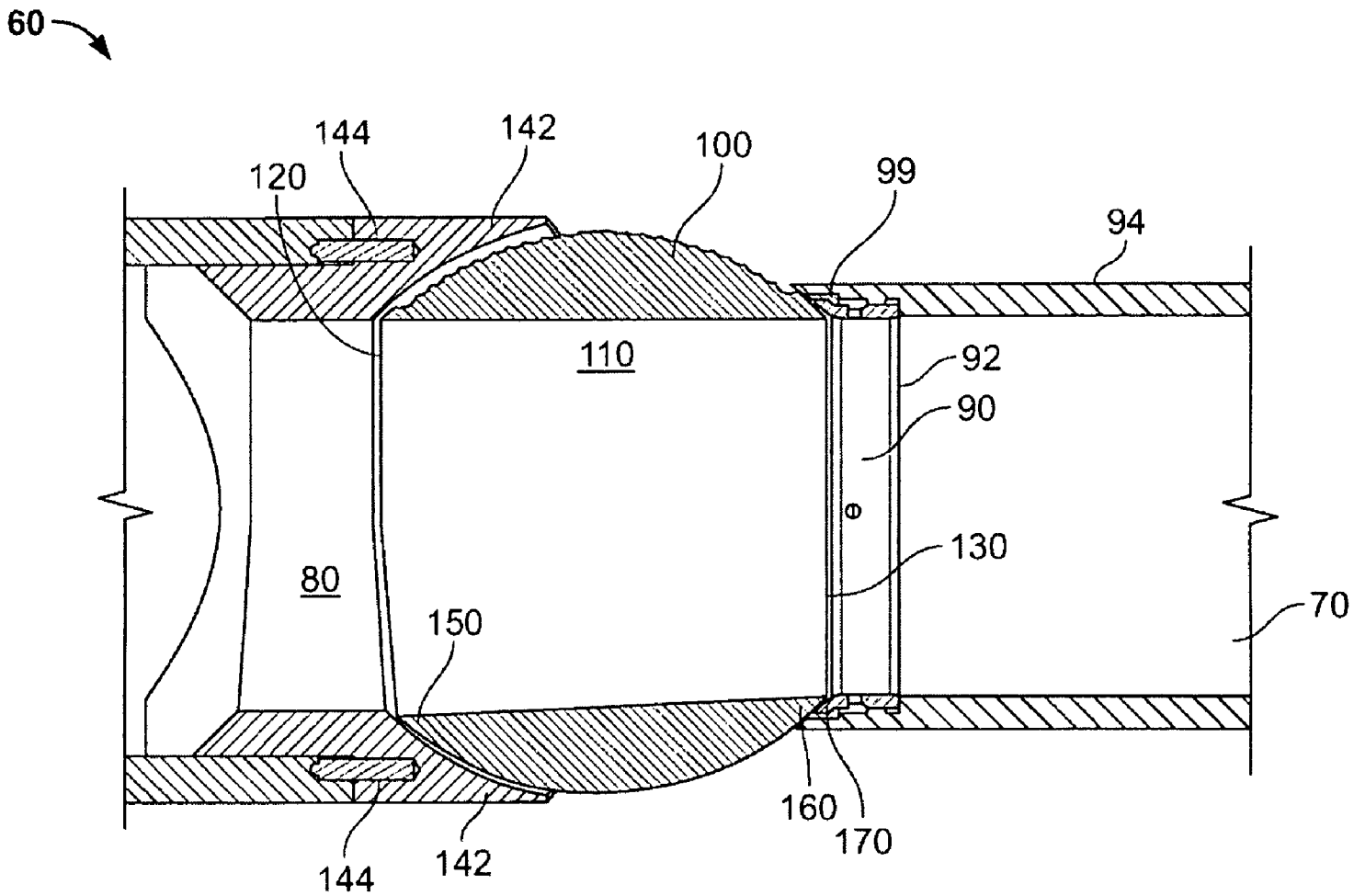
Figure 9:
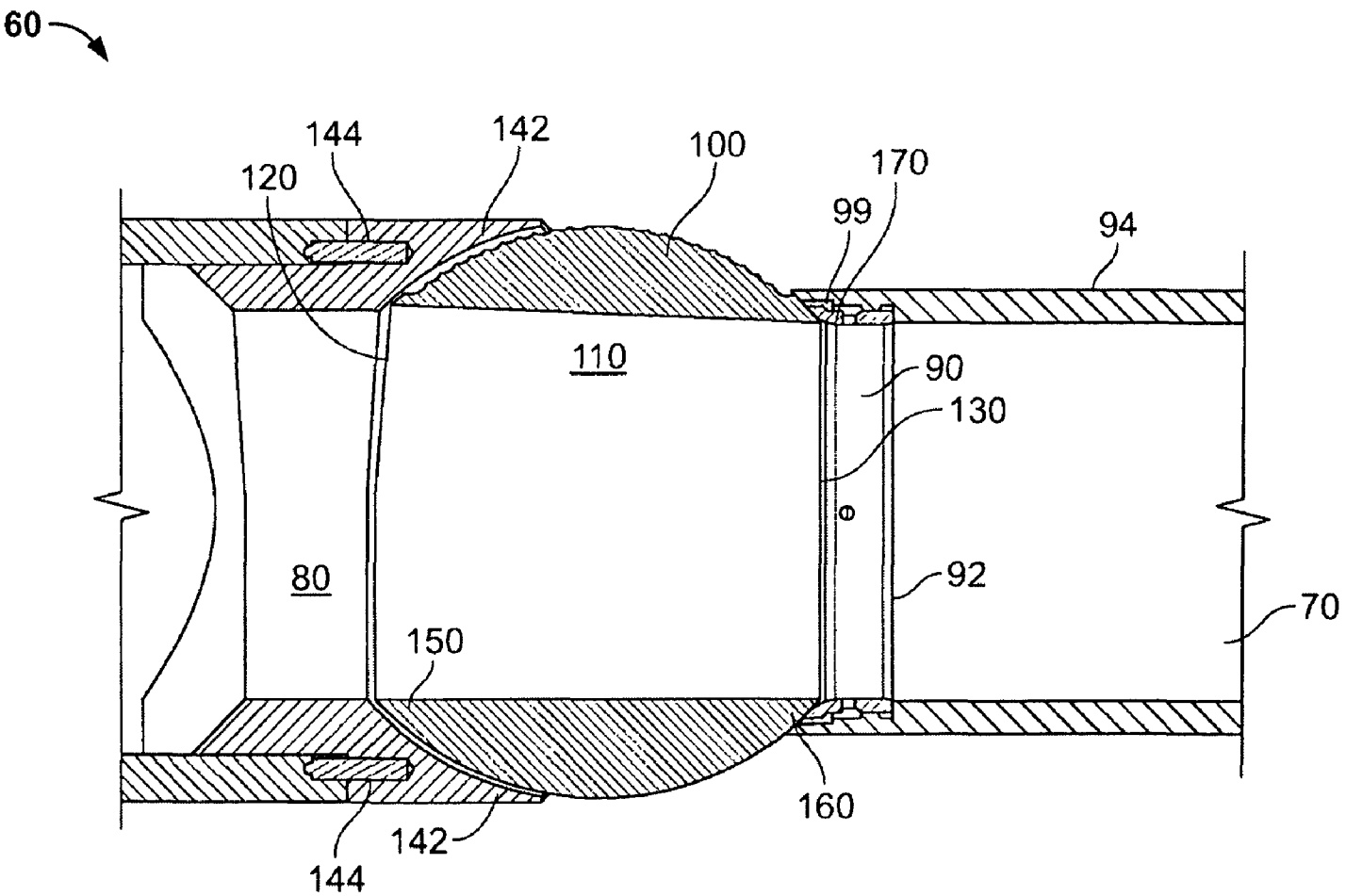

In some implementations, the second opening 130 may be smaller than the opening defined by the second bore portion 90. Alternately, the opening defined by the second bore portion 90 may be equal to or less than the size of the second opening 130. In other instances, the second bore portion 90 may have a flared portion 170 adjacent the ball 100. Thus, the second opening 130 may be smaller than the opening formed by the flared portion 170 of the second bore portion 90. Consequently, an area defined by the opening of the second bore portion 90 may entirely overlay the area defined by the second opening 130 over the drift clearance pivotal range. FIGS. 7-9 show the ball 100 in three different positions illustrating full drift clearance even while the ball 100 may be misaligned in the fluid pathway 70.

For the example ball valve 60 shown in FIGS. 7-9, the pivotal range of the ball 100 is 92 degrees, the drift clearance pivotal range is four degrees, although, as explained above, these ranges are merely an example. Thus, other implementations may include a pivotal range greater or less than 92 degrees, and the drift clearance pivotal range may be greater or less than four degrees. FIG. 7 shows the internal bore 110 centrally aligned with the first and second bore portions 80, 90. That is, a central axis of the internal bore 110 is aligned with a central axis of the first and second bore portions 80, 90 such that the ball 100 is positioned in the middle of the drift clearance pivotal range. Therefore, as shown in FIG. 7, the ball 100 is operable to pivot half of the drift clearance pivotal range (e.g., two degrees) in either direction and still provide full drift clearance through the fluid pathway 70. Thus, in the example shown, the ball is pivoted 90 degrees from the first position.

FIG. 8 shows the ball 100 pivoted to the second position, i.e., a maximum over-travel position. Thus, the ball 100 is shown pivoted to 92 degrees and at an end of the drift clearance pivotal range. FIG. 9 shows the ball pivoted to a maximum under-travel position. Accordingly, the ball 100 in FIG. 9 is pivoted to 88 degrees and at the other end of the drift clearance pivotal range. Therefore, although FIGS. 8 and 9 show the ball 100 in which the internal bore 110 is not centrally aligned with the first and second bore portions 80, 90, nonetheless, the fluid pathway 70 still enjoys maximum drift clearance. Consequently, for the example ball valve 60 shown in FIGS. 7-9, a position of the ball 100 anywhere between 88 and 92 degrees of pivot in the pivotal range provides for full drift clearance.

Referring to FIG. 7, as an example only, the orientation of the ball 100 may be such that the larger opening of the internal bore 110 (e.g., the first opening 120) may be disposed upstream of the smaller opening of the internal bore 110 (e.g., the second opening 130). That is when inserted into a downhole system, such as the downhole system 50, the first opening 120 is above (i.e., closer to the terranean surface 20) than the second opening 130. In such a configuration, the second housing portion 92 may form a seal around second opening 130 and/or the first housing portion 82 may form a seal around the first opening 120. Further, fluid may be introduced into the wellbore 10 from the terranean surface 20 or recovered from the wellbore 10 through the terranean surface 20 through the ball valve 60.

In other implementations, the ball 100 may be oriented such that the larger opening of the internal bore 110 (e.g., the first opening 120) is downhole, i.e., farther from the terranean surface 20, than the smaller opening of the internal bore 110 (e.g., the second opening 130). In such a configuration, the second housing portion 92 may form a seal around the second opening 130 and/or the first housing portion 82 may form a seal around the first opening 120. Additionally, fluid may be introduced into the wellbore 10 from the terranean surface 20 or recovered from the wellbore 10 through the terranean surface 20 through the ball valve 60.

Although the first opening 120 is described as larger than the second opening 130 in these examples, in other implementations, as explained above, the opposite may be true and the second opening 130 may be larger than the first opening 120.

A number of implementations have been described. Nevertheless, it will be understood that various modifications may be made without departing from the spirit and scope of the disclosure. Accordingly, other implementations are within the scope of the following claims.

What is claimed is:

1. A downhole tool for performing an operation downhole, the downhole tool comprising:

a tool portion defining a bore, the bore comprising:

a first bore portion; and a second bore portion; and a ball disposed between the first bore portion and the second bore portion and adapted to pivot between a first position and a second position;

the ball having an internal bore in the ball that extends from a first opening of the internal bore in the ball to a second opening of the internal bore in the ball, the first and second openings substantially aligned with a lengthwise axis of the internal bore in the ball;

the first opening being larger than the second opening and the first opening encompassing an opening defined by the first bore portion over a range of pivot of the ball, an opening defined by the second bore portion sized to encompass the second opening of the internal bore over a range of pivot of the ball.

2. The downhole tool of claim 1, wherein the first opening of the internal bore is elliptical having a minor axis at least as large as a width of the opening defined by the first bore portion and a major axis greater than a height of the opening defined by the first bore portion to encompass the opening defined by the first bore portion over a range of pivot of the ball.

3. The downhole tool of claim 1, wherein the range of pivot of the ball is four degrees.

4. The downhole tool of claim 1, wherein a pivotal range of the ball between the first position and the second position is 92 degrees.

5. The downhole tool of claim 1, wherein the internal bore transitions between the first opening and the second opening.

6. The downhole tool of claim 5, wherein at least a portion of the internal bore transitions parabolically, conically, or in a step-wise manner.

7. The downhole tool of claim 5, wherein the internal bore transitions over a length of the internal bore.

8. The downhole tool of claim 1, wherein an opening defined by the second bore portion adjacent the ball is flared and wherein the flared opening encompasses the second opening over a range of pivot of the ball.

9. The downhole tool of claim 1, wherein the internal bore comprises one of a smooth bore or a faceted bore.

10. The downhole tool of claim 1, wherein the first opening is coterminous with a first portion of an outer surface of the ball, and the second opening is coterminous with a second portion of the outer surface of the ball.

11. The downhole tool of claim 10, wherein the first and second portions of the outer surface of the ball are approximately 180 degrees apart on the outer surface of the ball.

12. The downhole tool of claim 1, wherein the internal bore comprises a tapered portion extending between the first opening of the internal bore and the second opening of the internal bore.

13. The downhole tool of claim 12, wherein the tapered portion of the internal bore comprises at least one of:

a conical taper extending between the first opening of the internal bore and the second opening of the internal bore;

a parabolic taper extending between the first opening of the internal bore and the second opening of the internal bore; or a stepped transition extending between the first opening of the internal bore and the second opening of the internal bore.

14. The downhole tool of claim 1, wherein the first opening comprises an inlet of the internal bore in the ball, and the second opening comprises an outlet of the internal bore of the ball.

15. A downhole tool for performing an operation within a wellbore, the downhole tool comprising:

a fluid pathway; and a ball disposed in the fluid pathway, the ball pivotable in the fluid pathway and having an internal bore in the ball, the internal bore comprising a first opening of the internal bore in the ball larger than a second opening of the internal bore in the ball, such that the first opening fully encompasses an opening of the fluid pathway adjacent the first opening over a range of pivot of the ball, the first and second openings substantially aligned with a lengthwise axis of the internal bore in the ball, an opening of the fluid pathway adjacent the second opening of the ball is flared and the flared opening of the fluid pathway fully encompasses the second opening of the ball over the range of pivot of the ball.

16. The downhole tool of claim 15, wherein the range of pivot of the ball is four degrees.

17. The downhole tool of claim 15, wherein the ball is pivotable over a full range of pivot and wherein the full range of pivot is 92 degrees.

18. The downhole tool of claim 15, wherein the first opening of the bore is elliptical, a minor axis of the elliptical first opening being at least as large as a width of the opening of the fluid pathway and the major axis of the first opening being greater than a height of the opening of the first bore portion to fully encompass the opening of the fluid pathway over the range of pivot of the ball.

19. The downhole tool of claim 18, wherein the second opening of the bore is circular and wherein the bore transitions from the elliptical first opening to the circular second opening over a length of the bore.

20. The downhole tool of claim 15, wherein a transition of the bore from the first opening to the second opening is at least partially parabolic, conical, or stepped.

21. The downhole tool of claim 15, wherein the bore comprises one of a smooth bore or a faceted bore.

22. The downhole tool of claim 15, wherein the first opening is coterminous with a first portion of an outer surface of the ball, and the second opening is coterminous with a second portion of the outer surface of the ball.

23. The downhole tool of claim 22, wherein the first and second portions of the outer surface of the ball are approximately 180 degrees apart on the outer surface of the ball.

24. The downhole tool of claim 15, wherein the bore comprises a tapered portion extending between the first opening of the bore and the second opening of the bore.

25. The downhole tool of claim 24, wherein the tapered portion of the bore comprises at least one of:

a conical taper extending between the first opening of the bore and the second opening of the bore;

a parabolic taper extending between the first opening of the bore and the second opening of the bore; and a stepped transition extending between the first opening of the bore and the second opening of the bore.

26. A method of controlling fluid flow through a downhole tool disposed downhole, the method comprising:

providing downhole a downhole tool including a ball disposed within a fluid pathway of the downhole tool, the ball including an internal bore in the ball and extending therethrough, the internal bore in the ball comprising a first opening larger than a second opening, the first and second openings substantially aligned with a longitudinal axis of the internal bore in the ball; and pivoting the ball within the fluid pathway to permit full communication down the fluid pathway, full communication permitted over a range of pivot of the ball, drift clearance through the ball and the fluid pathway are substantially maximized at full communication, the first opening positioned upstream of the second opening when the ball is pivoted within the fluid pathway to permit full communication down the fluid pathway.

27. The method of claim 26 further comprising pumping a fluid through the fluid pathway, the fluid comprising a proppant.

28. The method of claim 26 further comprising positioning the ball in a closed position to prevent or substantially prevent communication through the fluid pathway.

29. The method of claim 26, wherein the range of pivot of the ball is between approximately two degrees and approximately ten degrees.

30. The method of claim 26, wherein the first opening is coterminous with a first portion of an outer surface of the ball, and the second opening is coterminous with a second portion of the outer surface of the ball.

31. The method of claim 26, wherein the internal bore comprises a tapered portion extending between the first opening of the internal bore and the second opening of the internal bore.

32. A downhole tool for performing an operation downhole, the downhole tool comprising:

a tool portion defining a bore, the bore comprising:

a first bore portion; and a second bore portion; and a ball disposed between the first bore portion and the second bore portion and adapted to pivot between a first position and a second position;

the ball having an internal bore extending from a first opening of the internal bore to a second opening of the internal bore;

the first opening being larger than the second opening and the first opening encompassing an opening defined by the first bore portion over a range of pivot of the ball, wherein the first opening of the internal bore is elliptical having a minor axis at least as large as a width of the opening defined by the first bore portion and a major axis greater than a height of the opening defined by the first bore portion to encompass the opening defined by the first bore portion over a range of pivot of the ball.

33. A downhole tool for performing an operation within a wellbore, the downhole tool comprising:

a fluid pathway;

a ball disposed in the fluid pathway, the ball pivotable in the fluid pathway and having a bore, the bore comprising a first opening larger than a second opening such that the first opening fully encompasses an opening of the fluid pathway adjacent the first opening over a range of pivot of the ball, wherein the first opening of the bore is elliptical, a minor axis of the elliptical first opening being at least as large as a width of the opening of the fluid pathway and the major axis of the first opening being greater than a height of the opening of the first bore portion to fully encompass the opening of the fluid pathway over the range of pivot of the ball.

34. A downhole tool for performing an operation downhole, the downhole tool comprising:

a tool portion defining a bore, the bore comprising:

a first bore portion; and a second bore portion; and a ball disposed between the first bore portion and the second bore portion and adapted to pivot between a first position and a second position;

the ball having an internal bore that extends contiguously between a first opening of the internal bore and a second opening of the internal bore;

the first opening being larger than the second opening and the first opening encompassing an opening defined by the first bore portion over a range of pivot of the ball, the first opening coterminous with a first portion of an outer surface of the ball, and the second opening coterminous with a second portion of the outer surface of the ball, an opening defined by the second bore portion sized to encompass the second opening of the internal bore over a range of pivot of the ball.

35. The downhole tool of claim 34, wherein at least a portion of the internal bore transitions parabolically, conically, or in a step-wise manner.

36. The downhole tool of claim 35, wherein the internal bore transitions over a length of the internal bore.

37. The downhole tool of claim 34, wherein an opening defined by the second bore portion adjacent the ball is flared and wherein the flared opening encompasses the second opening over a range of pivot of the ball.

38. A downhole tool for performing an operation within a wellbore, the downhole tool comprising:

a fluid pathway; and a ball disposed in the fluid pathway, the ball pivotable in the fluid pathway and having a bore that extends contiguously between a first opening of the bore and a second opening of the bore, the first opening larger than the second opening such that the first opening fully encompasses an opening of the fluid pathway adjacent the first opening over a range of pivot of the ball, the first opening coterminous with a first portion of an outer surface of the ball, and the second opening coterminous with a second portion of the outer surface of the ball, an opening defined by the fluid pathway is sized to encompass the second opening of the bore over a range of pivot of the ball.

39. The downhole tool of claim 38, wherein at least a portion of the internal bore transitions parabolically, conically, or in a step-wise manner.

40. The downhole tool of claim 38, wherein the internal bore transitions over a length of the internal bore.

41. The downhole tool of claim 40, wherein an opening defined by the second bore portion adjacent the ball is flared and wherein the flared opening encompasses the second opening over a range of pivot of the ball.

42. A downhole tool for performing an operation downhole, the downhole tool comprising:

a tool portion defining a bore, the bore comprising:

a first bore portion; and a second bore portion; and a ball disposed between the first bore portion and the second bore portion and adapted to pivot between a first position and a second position;

the ball having an internal bore in the ball that extends from a first opening of the internal bore in the ball to a second opening of the internal bore in the ball, the first and second openings substantially aligned with a lengthwise axis of the internal bore in the ball;

the first opening being larger than the second opening and the first opening encompassing an opening defined by the first bore portion over a range of pivot of the ball, an opening defined by the second bore portion adjacent the ball is flared and the flared opening encompasses the second opening over a range of pivot of the ball.

43. A downhole tool for performing an operation downhole, the downhole tool comprising:

a tool portion defining a bore, the bore comprising:

a first bore portion; and a second bore portion; and a ball disposed between the first bore portion and the second bore portion and adapted to pivot between a first position and a second position;

the ball having an internal bore in the ball that extends from a first opening of the internal bore in the ball to a second opening of the internal bore in the ball, the first and second openings substantially aligned with a lengthwise axis of the internal bore in the ball;

the first opening being larger than the second opening and the first opening encompassing an opening defined by the first bore portion over a range of pivot of the ball, the internal bore comprising one of a smooth bore or a faceted bore.

44. A downhole tool for performing an operation within a wellbore, the downhole tool comprising:

a fluid pathway; and a ball disposed in the fluid pathway, the ball pivotable in the fluid pathway and having an internal bore in the ball, the internal bore comprising a first opening of the internal bore in the ball larger than a second opening of the internal bore in the ball, such that the first opening fully encompasses an opening of the fluid pathway adjacent the first opening over a range of pivot of the ball, the first and second openings substantially aligned with a lengthwise axis of the internal bore in the ball, the bore comprising a tapered portion extending between the first opening of the bore and the second opening of the bore, the tapered portion of the bore comprising at least one of: a conical taper extending between the first opening of the bore and the second opening of the bore, a parabolic taper extending between the first opening of the bore and the second opening of the bore, or a stepped transition extending between the first opening of the bore and the second opening of the bore.

45. A downhole tool for performing an operation downhole, the downhole tool comprising:

a tool portion defining a bore, the bore comprising:

a first bore portion; and a second bore portion; and a ball disposed between the first bore portion and the second bore portion and adapted to pivot between a first position and a second position;

the ball having an internal bore that extends contiguously between a first opening of the internal bore and a second opening of the internal bore;

the first opening being larger than the second opening and the first opening encompassing an opening defined by the first bore portion over a range of pivot of the ball, the first opening coterminous with a first portion of an outer surface of the ball, and the second opening coterminous with a second portion of the outer surface of the ball, an opening defined by the second bore portion adjacent the ball is flared and the flared opening encompasses the second opening over a range of pivot of the ball.

46. A downhole tool for performing an operation within a wellbore, the downhole tool comprising:

a fluid pathway; and a ball disposed in the fluid pathway, the ball pivotable in the fluid pathway and having an internal bore that extends contiguously between a first opening of the bore and a second opening of the bore, the first opening larger than the second opening such that the first opening fully encompasses an opening of the fluid pathway adjacent the first opening over a range of pivot of the ball, the first opening coterminous with a first portion of an outer surface of the ball, and the second opening coterminous with a second portion of the outer surface of the ball, the bore transitions over a length of the internal bore and an opening defined by the fluid passageway adjacent the ball is flared and the flared opening encompasses the second opening over a range of pivot of the ball.

* * * * *